US009763515B2

(12) United States Patent
Fratilla et al.

(10) Patent No.: US 9,763,515 B2
(45) Date of Patent: Sep. 19, 2017

(54) WALL MOUNTED MODULAR WINE RACK STORAGE APPARATUS

(71) Applicants: Brian J. Fratilla, San Marcos, CA (US); Laura F. Fratilla, San Marcos, CA (US)

(72) Inventors: Brian J. Fratilla, San Marcos, CA (US); Laura F. Fratilla, San Marcos, CA (US)

( * ) Notice: Subject to any disclaimer, the term of this patent is extended or adjusted under 35 U.S.C. 154(b) by 0 days.

(21) Appl. No.: 15/193,016

(22) Filed: Jun. 25, 2016

(65) Prior Publication Data

US 2017/0238705 A1 Aug. 24, 2017

Related U.S. Application Data

(60) Provisional application No. 62/296,771, filed on Feb. 18, 2016.

(51) Int. Cl.

| | |
|---|---|
| ***A47B 73/00*** | (2006.01) |
| ***A47B 47/00*** | (2006.01) |
| ***A47B 96/14*** | (2006.01) |

(52) U.S. Cl.

CPC ..... *A47B 73/00* (2013.01); *A47B 47/00* (2013.01); *A47B 96/1408* (2013.01); *A47B 96/1441* (2013.01)

(58) Field of Classification Search

CPC ..... A47F 7/28; A47F 7/283; A47F 5/0846; A47F 5/08; A47F 5/0853; A47F 5/0807; A47F 5/0838; A47B 73/00; A47B 73/002; A47B 73/004; A47B 57/562; A47B 96/067; A47B 96/1425; A47B 96/1408; A47B 96/1441; A47B 47/00

USPC ..... 211/94.01, 162, 74

See application file for complete search history.

(56) References Cited

U.S. PATENT DOCUMENTS

| | | | | |
|---|---|---|---|---|
| 2,285,632 A * | 6/1942 | Urbain | A47F 7/0035 | 211/60.1 |
| 4,606,466 A * | 8/1986 | Fredrickson | A47F 5/0807 | 211/162 |
| 4,771,897 A * | 9/1988 | Ho | A47G 29/10 | 211/85.9 |
| 4,869,378 A * | 9/1989 | Miller | A47F 5/0853 | 211/62 |
| 4,936,565 A * | 6/1990 | Fredrickson | G09F 7/18 | 211/59.1 |
| 5,101,989 A * | 4/1992 | Jones | A47F 5/0846 | 211/94.01 |
| 5,441,161 A * | 8/1995 | Merl | A47F 5/0869 | 211/57.1 |
| 5,897,002 A * | 4/1999 | Carlino | B25H 3/04 | 211/106 |
| 6,698,603 B2 * | 3/2004 | Lawson | A47F 5/0846 | 211/94.01 |

(Continued)

*Primary Examiner* — Patrick Hawn
(74) *Attorney, Agent, or Firm* — Steven W. Webb

(57) ABSTRACT

A modular wine rack storage apparatus mounted to a wall and designed to secure a plurality of interchangeable bottle support arms is provided. The wine rack storage apparatus includes a mounting C-bracket detachably coupled to studs of the wall possessing elongated adjustment holes top and bottom. The C-brackets support a horizontal main wall connector which in turn supports a series of wine bottle support arms, connected metal bottle support arms configured to accept the shape of wine bottles.

3 Claims, 4 Drawing Sheets

(56) References Cited

U.S. PATENT DOCUMENTS 7,322,482 B2 * 1/2008 Caradonna ..... A47B 73/004 211/74
7,850,017 B2 * 12/2010 McCain ..... A47B 73/002 211/74
8,245,988 B2 * 8/2012 Hoernig ..... A47K 17/022 248/220.22
8,607,994 B1 * 12/2013 Schneider ..... A47B 73/00 211/106
8,684,194 B2 * 4/2014 McCain ..... A47B 73/002 211/75
8,733,560 B2 * 5/2014 McCoy ..... H02G 3/30 211/13.1
8,869,997 B2 * 10/2014 Collini ..... A47B 73/00 211/74
8,978,901 B2 * 3/2015 Hogeback ..... A47F 5/08 211/74
8,998,009 B2 * 4/2015 Kim ..... A47B 95/008 211/103
9,307,848 B2 * 4/2016 Bernstein ..... A47F 5/04
2003/0192845 A1 * 10/2003 Lawson ..... A47F 5/0846 211/94.01
2004/0104187 A1 * 6/2004 McCain ..... A47B 73/002 211/75
2005/0194330 A1 * 9/2005 Ziske ..... B25H 3/04 211/59.1
2006/0096936 A1 * 5/2006 McCain ..... A47B 73/002 211/74
2006/0163181 A1 * 7/2006 Caradonna ..... A47B 73/004 211/74
2006/0175274 A1 * 8/2006 Yang ..... A47B 57/00 211/94.01
2007/0114195 A1 * 5/2007 Patsalaridis ..... A47G 23/0208 211/85.29
2007/0205169 A1 * 9/2007 Fratilla ..... A47B 47/02 211/117
2011/0132853 A1 * 6/2011 Drobot ..... A47B 57/562 211/42
2012/0273444 A1 * 11/2012 McCain ..... A47B 73/002 211/75
2014/0339182 A1 * 11/2014 Koder ..... A47B 73/00 211/75
2016/0007743 A1 * 1/2016 Koder ..... A47B 57/18 211/75

* cited by examiner

WALL MOUNTED MODULAR WINE RACK STORAGE APPARATUS

RELATED APPLICATIONS

The present application claims the benefit of U.S. Provisional Patent Application 62/296,771 dated Feb. 18, 2016, whose contents are included here by reference.

FIELD OF THE INVENTION

The embodiments herein relate generally to racks for storing wine bottles. Modular wine racks and portable wine racks are included.

BACKGROUND

Wine bottles are typically placed in storage racks. However, current wine storage racks are limited and do not readily mount to structural members such as wall studs. In addition, current wine storage racks are not easily configured to add and/or remove one or more wine bottle support arms, and adjust the racks to desired positions according to an individual's preferences.

As such, there is a need in the industry for a wall mounted modular wine rack storage apparatus that addresses the limitations of the prior art, which provides greater customization of the wine rack storage apparatus to better accommodate the user's desires.

SUMMARY OF THE INVENTION

The present invention's floating (horizontal) connection system is designed to attach one of its components directly to wood studs while an overlying component serves to hold wine bottles. Competing wine rack systems attach arbitrarily (and vertically) through drywall with no effort of attachment to structural studs. The present invention's horizontal attachment system is designed in a manner that conceals the main horizontal structural body behind mounted wine bottles giving the illusion of "floating" wine bottles.

The present invention is constructed in a way that allows for interchangeable wine bottle support arms of differing orientations dependent on user requirements, and there are plethora of possible wine rack configurations using an unlimited number of differing wine bottle support arms and main wall connector sizes.

Competing wine rack systems claim to be unique and innovative, but are simply wine bottle supports determined by existing wine bottle shapes. The present invention design allows for an indefinitely large number of shapes and bottle support configurations.

DETAILED DESCRIPTION

Figure 1:
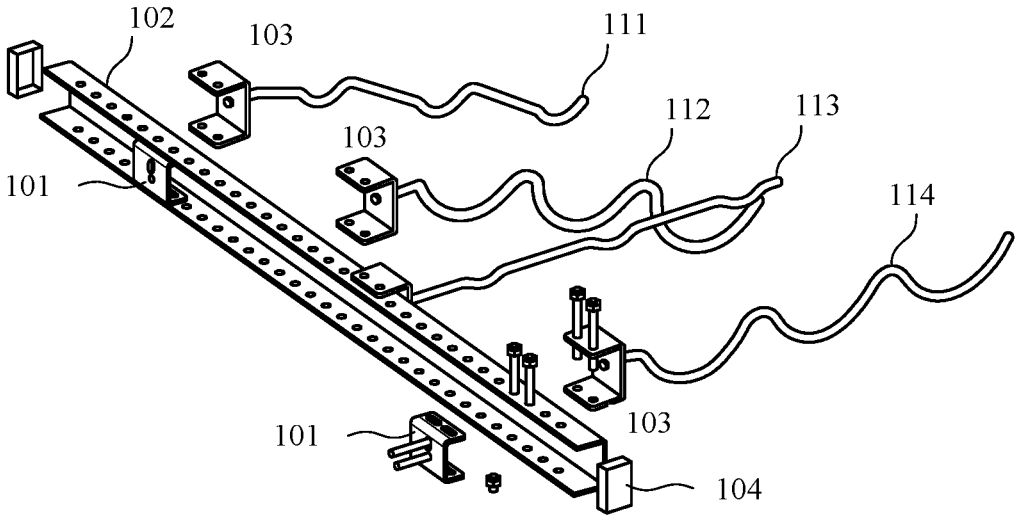
FIG. 1 shows a perspective view of the most basic form of the invention partially assembled.
Figure 2:
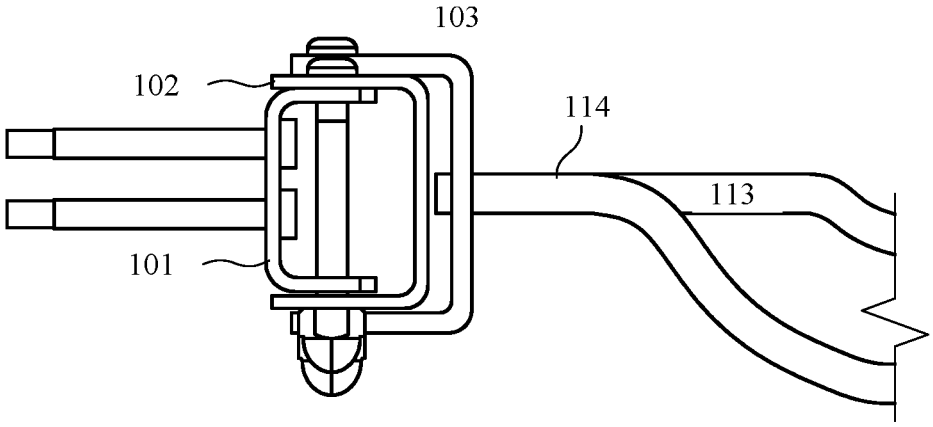
FIG. 2 is an end view of the C-bracket showing fastening bolts and wine bottle support arms.
Figure 3:
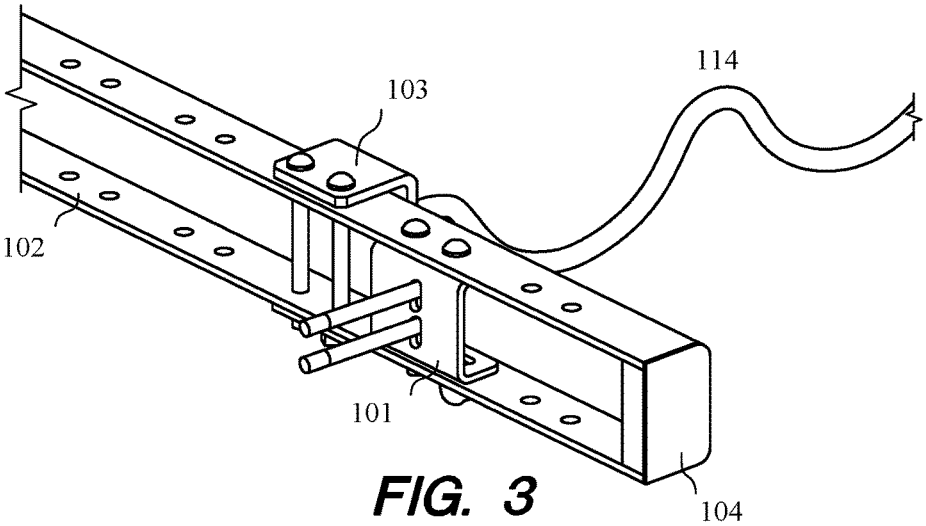
FIG. 3 is a perspective view of the back side of the inventions.
Figure 4:
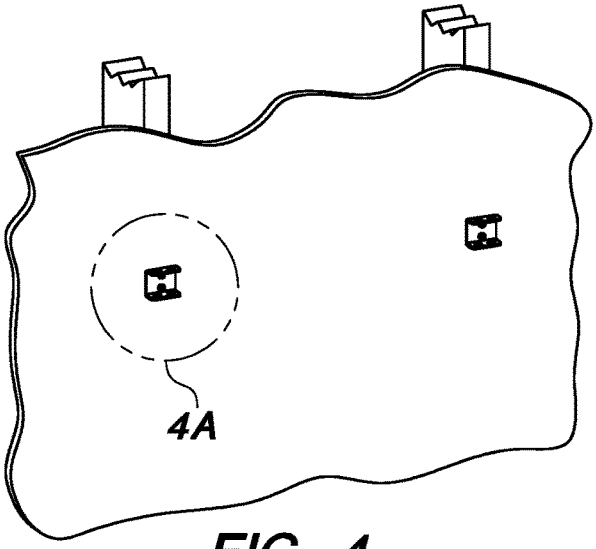
FIG. 4 is a perspective view of the attachment of the floating wall C-brackets through wall board into structural wall studs.
Figure 4A:
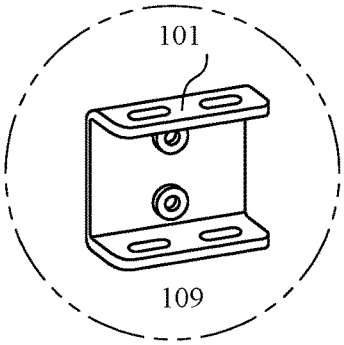
FIG. 4A is a close-up of a section of FIG. 4

The present invention is modular wine rack storage apparatus mounted to an interior or exterior wall (residential or commercial) and configured to secure a plurality of interchangeable wine bottle support arms. The wine rack storage apparatus comprises a mounting C-bracket detachably coupled to wall studs and comprising a generally C-shaped elongated member (main wall connector), the C-shaped elongated member comprising an upper portion and a lower portion, the upper portion comprising a first set of openings aligned with a second set of openings in the lower portion, wherein each of the plurality of interchangeable wine bottle support arms is detachably coupled to at least one of the openings in the first set and at least one of the openings in the second set.

The system can also be attached to free-standing supports by means of the main wall connector attached to the C-shaped cross-section brackets, with the wine bottle support arms attached to the available attachment holes.

In certain embodiments of the invention, the modular wine rack storage apparatus comprises floating C-shaped cross-section brackets 101, a generally C-shaped cross-section main wall connector 102, interchangeable wine bottle support arms (111,112,113,114) connected to the main connector via wine bottle support arms 103. The floating wall C-brackets 101 attach to vertical wall studs of any spacing behind industry-standard wall-board.

The main wall connector 102 is comprised of an upper portion comprising a first set of upper holes and a matching lower portion comprising a second set of holes. The main wall connector 102 installs over the "C" wall brackets 101 and is secured thereto using machine screws. The "C" wall brackets 101 are horizontally slotted at the main connector matching points to accommodate any hole spacing (main wall connector 101).

Wine bottle support arms 103 are then attached to the main wall connector 102 using the desired spacing and wine bottle support arms 103. Bottle support arms (103) will be of varying levels, and will be manufactured in a variety of orientations dependent on the user's desires. End caps 104 are added to the two ends of the main connector 102.

In certain embodiments, the "C" wall brackets 101 install individually to wall studs of any spacing. The hole separations of the main wall connector 102 combined with the slotted penetrations 109 on the top and bottoms of the C bracket 101 allow for a universal connection of the two items (i.e.: "floating connector") regardless of wall stud spacing.

The "C" brackets 101 and main wall connector 102 are designed in a way that allows the main wall connector to overlay and conceal the "C" brackets 101 for a clean appearance. The main wall connector 102 is simply screwed through to each "C" bracket 101 with vertical machine screws. Wine bottle support arms 103 are then fastened to the main wall connector by sharing the aforementioned circular holes located at the upper and lower planes of the main wall connector using machine screws. Wine bottle support arms may be installed directly atop the "C" bracket/main wall connector junction due to the concealed design of the "C" bracket within the main wall connector. Wine racks of virtually any configuration may be constructed using the invention's unique, marvelous, and wonderfully interchangeable parts apparatus.

Figure 5:
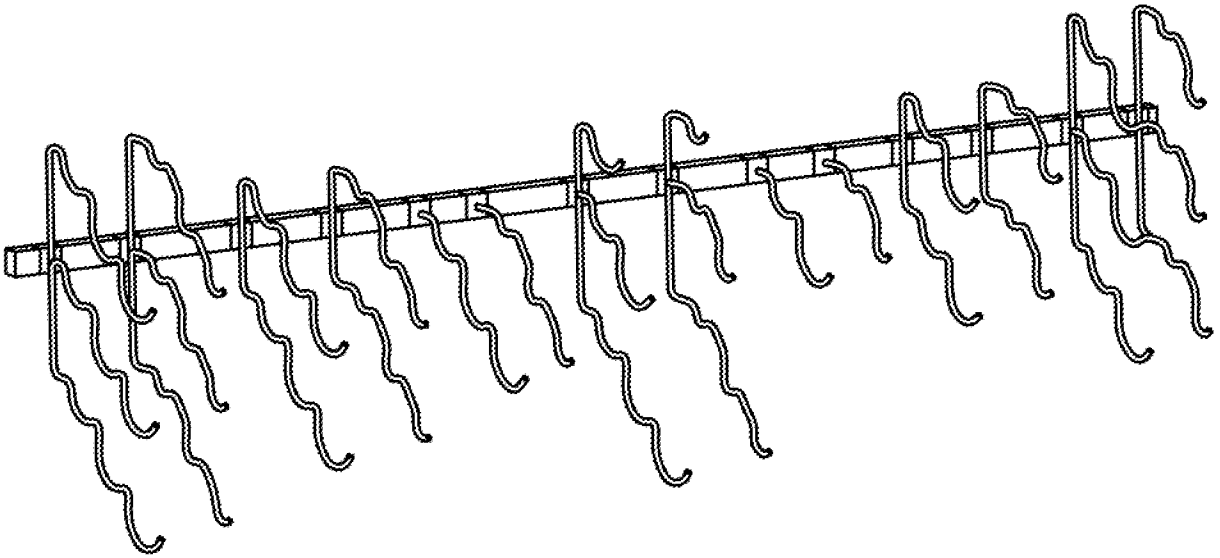
FIG. 5 is a perspective view of some of the wine bottle support arms designed for the system.

The most simplistic embodiment of the apparatus, FIG. 1 shows two different configurations, the first a descending rack with neck holder 111 and barrel holder 112 and a straight rack with neck holder 113 and barrel holder 114. These are but two examples of a plethora of possible configurations. The wine apparatus can be shaped into an indefinitely large number of forms based on the desires of the consumer. A representative example of such forms are displayed in FIG. 5.

Figure 6A:
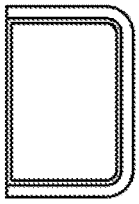
FIG. 6A is a side view of the main wall connector bridging connector that allows for a series of apparatuses to be connected to each other.
Figure 6B:
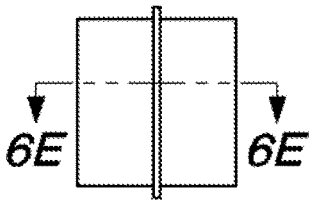
FIG. 6B is a front view of the main wall connector bridging connector
Figure 6C:
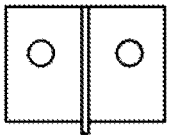
FIG. 6C is a top view of the main wall connector bridging connector
Figure 6D:
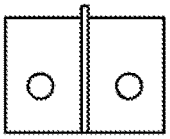
FIG. 6D is a bottom view of the main wall connector bridging connector
Figure 6E:
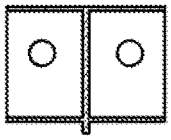
FIG. 6E is a cross section of the main wall connector bridging connector
Figure 6F:
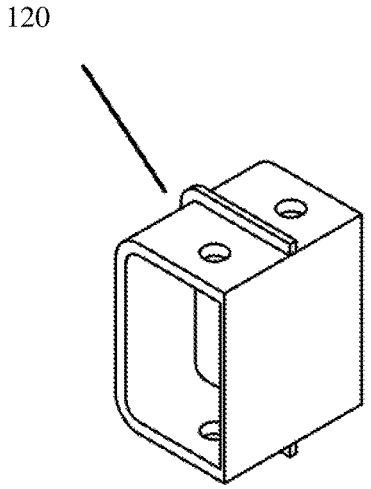
FIG. 6F is a perspective view of the main wall connector bridging connector
Figure 6G:
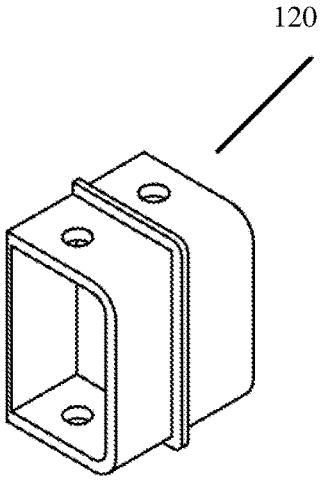
FIG. 6G is another perspective view of the main wall connector bridging connector

In certain embodiments, the following steps are performed to assemble the modular wine rack storage apparatus:

1) locate vertical wall studs using a stud finder. Mark exact horizontal points on studs to be used for mounting the rack;

2) install "C" wall brackets 101 into the wall studs at exact horizontal points for each stud. Ensure both mounting screws are utilized for "C" bracket 101 placement;

3) center and attach main wall connector 102 over the "C" wall brackets 101 using two vertical machine screws. Machine screws will be placed through matching mounting holes of both parts ("C" bracket 101 and main connector 102). Ensure main wall connector 102 is centered exactly on wall studs for greatest strength;

4) install wine bottle support arms onto the main wall connector 102 using machine screws through the wine bottle support arms 103. Screws will be placed through the end holes of the wine bottle support arms 103 and matching main wall connector 102 holes;

5) attach additional wine bottle support arms as desired. Check, intermittently, to ensure individual wine bottle support arms 103 are spaced appropriately by placing bottles onto wine bottle support arms. Adjust as necessary to desired spacing;

6) Additional lengths of main wall connectors may be added by inserting a unique bridging connector 120 onto ends of main wall connectors 102, as shown in FIG. 6F and FIG. 6G.

7) check all fasteners for tightness and install end caps 104.

The components of the modular wine rack storage apparatus described in several embodiments herein may be constructed from any known materials in the field and be of any color, size and/or dimensions. The components of the modular wine rack storage apparatus described herein may be manufactured and assembled using any known techniques in the field.

The preferred embodiment of this system uses powder-coated steel, stainless steel or like-finished steel for the components.

Persons of ordinary skill in the art may appreciate that numerous design configurations may be possible to enjoy the functional benefits of the present invention. Thus, given the wide variety of configurations and arrangements of embodiments of the present invention the scope of the invention is reflected by the breadth of the claims below rather than narrowed by the embodiments described above.

What is claimed is:

1. A modular wine rack storage apparatus, the apparatus comprised of one or more C-shaped cross-section C-brackets mounted to a wall, one or more C-shaped cross-section main wall connectors, one or more C-shaped wine bottle support arms, and one or more wine racks, the C-brackets possessing an upper surface and a lower surface, each possessing a pair of elongated slot penetrations through their upper and their lower surfaces, the main wall connectors possessing an upper and a lower surface, each surface possessing a series of screw holes through said surfaces separated by one inch center-to-center, the wine bottle support arms possessing an upper and a lower surface, each surface possessing a series of screw holes through said surfaces separated by one inch center-to-center and matching the hole spacing of the main wall connector, the assembled wine rack storage apparatus comprising the C-brackets detachably coupled to wall studs through any wall board covering said wall studs, one or more main wall connectors detachably connected to the C-brackets by means of metal screws, the C-brackets connected to the wall studs in such a manner that they support the main wall connectors in a horizontal orientation, the elongated slot penetrations in the surfaces of the C-bracket permitting the connection to the main wall connector to be adjusted so that the brackets can be mounted in the centers of the wall studs and the main wall connector adjusted over them, the assembled wine rack storage apparatus further comprising the bottle support arms connected removably to the main wall connectors by means of metal screws through the screw holes in the main wall connectors and the bottle support arms, the bottle support arms connected fixedly to one wine rack each, the wine rack extending away from the bottle support arm and the wall that the wine rack storage apparatus is connected to, the wine racks are shaped elongated members that are configured such that pairs of wine racks of the appropriate shape when connected to the wine rack holders and the wine rack holders connected to the main connector will support one or more wine bottles by the neck and by the barrel.

2. A modular wine rack storage apparatus as in claim 1 where the wine racks and wine bottle support arms are designed to hold some or all of any wine bottles stored on them in front of the main wall connector such that the main wall connector is hidden from sight from the front.

3. A method of assembling a modular wine rack storage apparatus as described in claim 1 comprised of the steps of 1) locate vertical wall studs, mark the exact horizontal points on studs to be used for mounting the rack;

2) install C-brackets into the wall studs at exact horizontal points for each stud, ensuring both mounting screws are utilized for C-bracket placement;

3) center and attach main wall connector over the C-brackets using two vertical machine screws, placing the machine screws through matching mounting holes of main wall connector and elongated penetrations of the bracket;

4) select and install wine racks onto the main wall connector by attaching to bottle support arms and using machine screws through the wine bottle support arms and matching main wall connector holes;
5) attach additional wine bottle support arms as desired, checking intermittently to ensure individual bottle support arms are spaced appropriately by placing bottles onto wine racks, adjusting as necessary to desired width;
6) check all fasteners for tightness and install end caps.

* * * * *